US006708545B1

(12) United States Patent
Hamm et al.

(10) Patent No.: US 6,708,545 B1
(45) Date of Patent: Mar. 23, 2004

(54) ROLL GROOVING APPARATUS

(75) Inventors: James E. Hamm, Grafton, OH (US); Richard R. Bowles, Solon, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/292,961

(22) Filed: Nov. 13, 2002

(51) Int. Cl.[7] ..... B21D 15/04
(52) U.S. Cl. ..... 72/106; 72/105; 72/453.16
(58) Field of Search ..... 72/105, 106, 109, 72/111, 115, 118, 120, 121, 453.16

(56) References Cited

U.S. PATENT DOCUMENTS

| | | | | |
|---|---|---|---|---|
| 1,810,342 A | | 6/1931 | Bulger et al. | |
| 3,548,623 A | | 12/1970 | Hess et al. | |
| 3,903,722 A | | 9/1975 | Thau, Jr. et al. | |
| 4,041,747 A | | 8/1977 | Elkin | |
| 4,121,442 A | * | 10/1978 | Brooks | 72/54 |
| 4,166,370 A | * | 9/1979 | Goodman | 72/105 |
| 4,522,054 A | * | 6/1985 | Wilson et al. | 72/392 |
| 5,778,715 A | | 7/1998 | Lippka et al. | |
| 6,408,664 B1 | * | 6/2002 | Williams | 72/105 |

FOREIGN PATENT DOCUMENTS

GB 2 014 072 8/1979

OTHER PUBLICATIONS

The Ridge Tool Company, RIDGID Catalog No. RT–199, Jan. 1999, p. 58.
Victaulic Company of America, Operating and Maintenance Instructions Manual for VE416 FS and VE416FSD, pp. 5, 10, 13, 14, and 15, copyright 1997.
Victaulic Company of America, Operating and Maintenance Instructions for VE272FS, pp. 6, 7 and 15, copyright 1997.

* cited by examiner

*Primary Examiner*—Ed Tolan
(74) *Attorney, Agent, or Firm*—Fay, Sharpe, Fagan, Minnich & McKee LLP

(57) ABSTRACT

Hydraulically operated roll grooving apparatus comprises vertically oriented idler and backup grooving rolls each rotatable about a corresponding roll axis, a fluid actuator for displacing the idler roll toward the backup roll, a manually operated pump for supplying fluid under pressure to the fluid actuator, and a stabilizer for stabilizing a pipe being roll grooved. The pump and stabilizer are mounted on the same side of the apparatus with respect to the roll axes, and the pump has a vertically oriented major dimension and a pump operating lever including a removable handle.

47 Claims, 6 Drawing Sheets

ROLL GROOVING APPARATUS

BACKGROUND OF THE INVENTION

This invention relates to the art of roll grooving apparatus and, more particularly, to improvements in such apparatus relating to the portability thereof and the versatility thereof in use.

The present invention finds particular utility in connection with portable roll grooving apparatus of the character removably supported on a separate power drive unit which includes spaced apart and parallel support elements for the roll groover and a drive motor having a drive coupling for driving interconnection with a drive shaft of the roll grooving apparatus. While the invention will be illustrated and described herein in connection with such a portable roll groover, it will be understood and appreciated from the disclosure herein that the invention is applicable to other roll grooving apparatus including apparatus integrally mounted on a support and/or drive mechanism.

Generally, roll grooving apparatus includes relatively displaceable first and second support components which respectively rotatably support a driven grooving roll and an idler grooving roll between which a pipe to be grooved is interposed during a grooving operation. The grooving rolls are matingly contoured and, in this respect, the driven roll is provided with a peripheral groove and the idler roll is provided with a peripheral projection such that a pipe therebetween is provided with a peripheral groove upon relative rotation of the grooving rolls and relative radial displacement of the grooving rolls toward one another. In hydraulically operated roll grooving apparatus heretofore available, displacement of the support components toward and away from one another is achieved by a manually operated hydraulic pump having its major dimension extending laterally outwardly from one side of the apparatus and having a pump handle which also extends laterally outwardly of the apparatus and beyond the outer end of the pump. Moreover, the pump handle is not intended to be removable from the pump. Further, such roll grooving apparatus heretofore available often includes a pipe stabilizer arrangement extending laterally outwardly of the apparatus from the side thereof opposite the side on which the pump is mounted. The stabilizer generally includes a support member slidably supporting a carriage which is displaceable laterally inwardly and outwardly of the apparatus by a crank at the outer end of the support and which includes a rotatable wheel for engaging and stabilizing a pipe being roll grooved.

In roll grooving apparatus of the foregoing character, either one of the pump or stabilizer alone adds considerable lateral width to the basic roll grooving apparatus making it difficult and sometimes impossible to maneuver the apparatus through a doorway or the like without removing one or both of the pump and stabilizer from the apparatus. It will be appreciated that if the apparatus includes both a pump and stabilizer, the foregoing problem is magnified. Even if the pump and stabilizer are on the same side of the apparatus, removal of either one of the two alone does not assure the desired maneuverability. In addition to being difficult to get through narrow doorways, the apparatus is difficult to physically handle in connection with transporting the apparatus from one location to another. Moreover, it will be appreciated that it is time consuming, if not difficult, to have to remove one or both of the pump and stabilizer in connection with transporting the apparatus and then remounting the pump and/or stabilizer upon reaching a work location. A further problem encountered with roll grooving apparatus heretofore available results from the fact that different sizes of stabilizers are necessary to accommodate a wide range of pipe sizes to be roll grooved. In this respect, the adjustment capability of a given stabilizer is limited, whereby one size of stabilizer is capable of working with one range of pipe sizes such as, for example, two inch to sixteen inch pipe, and a larger stabilizer is necessary for the apparatus to accommodate the roll grooving of pipes from, for example, sixteen to twenty-four inches. Having to provide two different sizes of stabilizers not only increases the cost of the apparatus but requires inventorying extra parts and storing the same. Moreover, time and effort is required on the part of the user when it becomes necessary to remove one stabilizer and replace it with the other.

SUMMARY OF THE INVENTION

Improvements are provided in accordance with the present invention by which the foregoing and other disadvantages of roll grooving apparatus heretofore available are minimized or overcome. More particularly in this respect, the manually operated hydraulic pump of roll grooving apparatus in accordance with the invention is mounted for the major dimension of the pump to provide an axis lying in a vertical plane and, preferably, with the axis extending vertically. The pump in a preferred embodiment comprises a housing and a hydraulic fluid reservoir, and the pump handle, during use, extends laterally outwardly from the housing and reservoir and is displaceable relative thereto for pumping fluid from the reservoir to the support member on which the idler grooving roll is mounted for displacement of the latter grooving roll toward the driven grooving roll. Further in accordance with the invention, the pump handle has a non-use position or location in which it does not extend laterally outwardly of the apparatus, and such non-use location or position can be provided by removing the handle from the pump and/or by interconnecting the handle with the pump in a manner which provides for the handle to pivot and/or swivel relative to the pump to a position in which the handle does not extend laterally outwardly of the apparatus to the extent that it does during use. In any event, it will be appreciated that the disposition of the pump axis in accordance with the invention narrows the lateral width of the apparatus relative to such apparatus heretofore available, and that the disposition of the handle in the non-use position or location thereof further promotes minimizing the lateral width of the apparatus. Of further advantage is the fact that the removability of the handle enables the use of different length handles in accordance with parameters of a given roll grooving operation such as, for example, the pipe material, pipe size, wall thickness and the like.

In accordance with another aspect of the invention, a pipe stabilizer is mounted on the same side of the apparatus as is the pump, thus promoting a reduction of the overall width of the apparatus in comparison with such apparatus heretofore available. Preferably, the stabilizer is selectively mountable in either one of two laterally spaced apart locations on the apparatus. This effectively increases the total stroke of the stabilizer relative to pipes being roll grooved, whereby a larger range of pipe sizes can be roll grooved on the same apparatus simply by shifting the mounting position of the stabilizer. Of further advantage is the fact that a smaller stabilizer heretofore used for roll grooving pipes from two inches to sixteen inches, for example, can be used to increase the roll grooving range to pipes up to twenty-four inches, for example. Accordingly, it will be appreciated that the mounting of the stabilizer on the same side of the apparatus as the pump and enabling the use of a smaller size stabilizer both narrows the overall width of the apparatus in comparison with roll groovers heretofore available while providing for the apparatus to accommodate a larger range of pipe sizes. It will be appreciated, therefore, that roll grooving apparatus in accordance with the present invention provides advantageous improvements in connection with both the portability and versatility of roll grooving apparatus.

It is accordingly an outstanding object of the present invention to provide improvements in connection with hydraulically actuated roll grooving apparatus.

Another object is the provision of roll grooving apparatus of the foregoing character in which the major dimension of the pump of the hydraulic system is oriented relative to the apparatus in a manner to narrow the lateral width thereof relative to roll grooving apparatus heretofore available.

A further object is the provision of roll grooving apparatus of the foregoing character wherein the axis of the hydraulic pump with respect to the major dimension thereof is vertical.

Yet another object is the provision of roll grooving apparatus of the foregoing character which includes a pipe stabilizer associated with the apparatus in a manner to promote narrowing of the width thereof in comparison with such apparatus heretofore available.

Still a further object is the provision of roll grooving apparatus of the foregoing character in which the stabilizer is adapted to be selectively associated with the apparatus in a manner which provides for the apparatus to accommodate a larger range of pipe sizes with the same size stabilizer than heretofore possible.

Yet another object is the provision of roll grooving apparatus of the foregoing character in which the pump handle is adapted to be associated with the pump in a manner which allows displacement of the handle to a non-use position or location so as to promote lateral compactness of the apparatus.

Still another object of the invention is the provision of improvements in roll grooving apparatus of the foregoing character which promote portability of the apparatus and versatility in connection with the use thereof.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
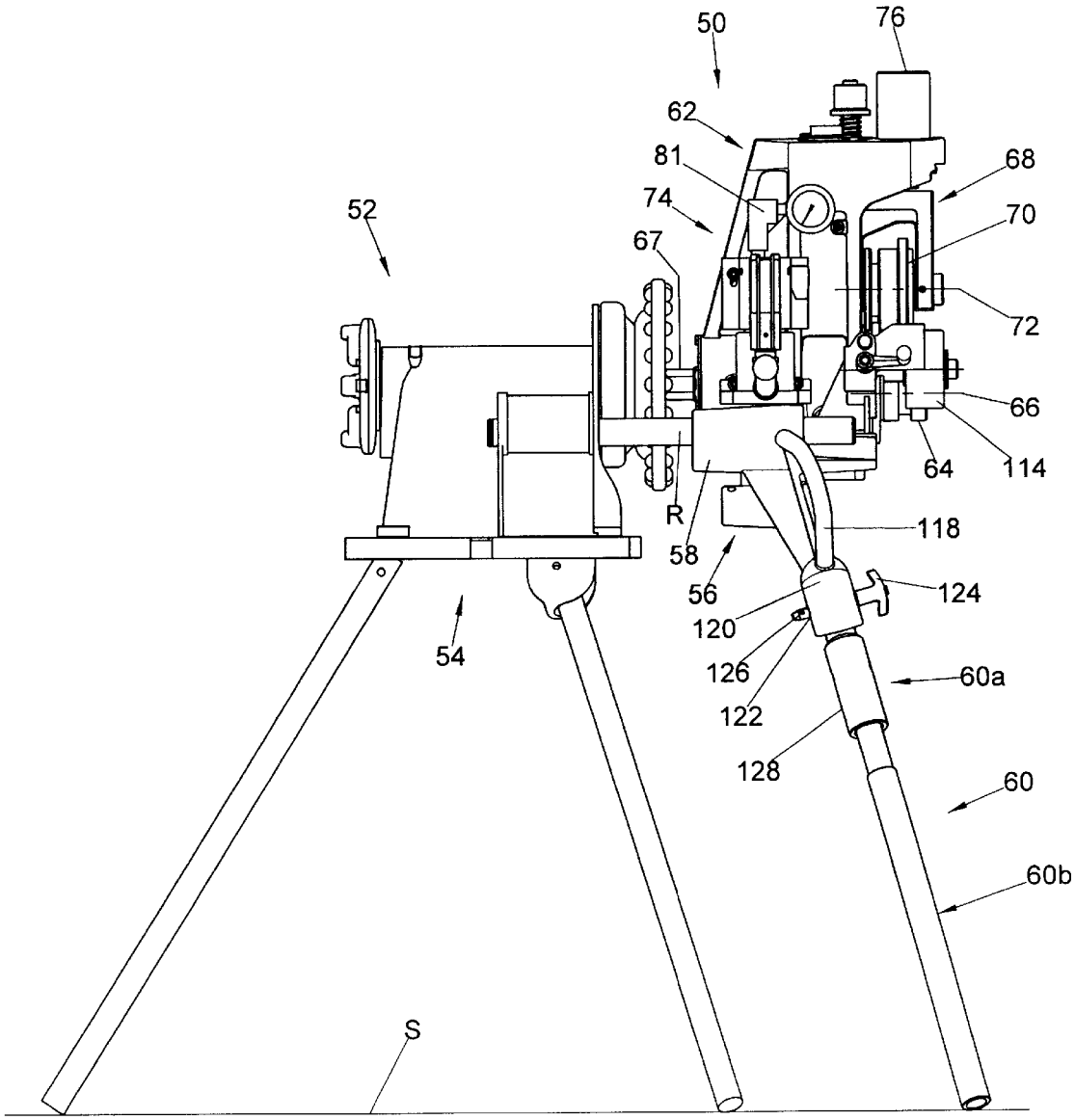
FIG. 1 is a side elevation view showing roll grooving apparatus according to the invention associated with a drive unit for driving the apparatus.
Figure 2:
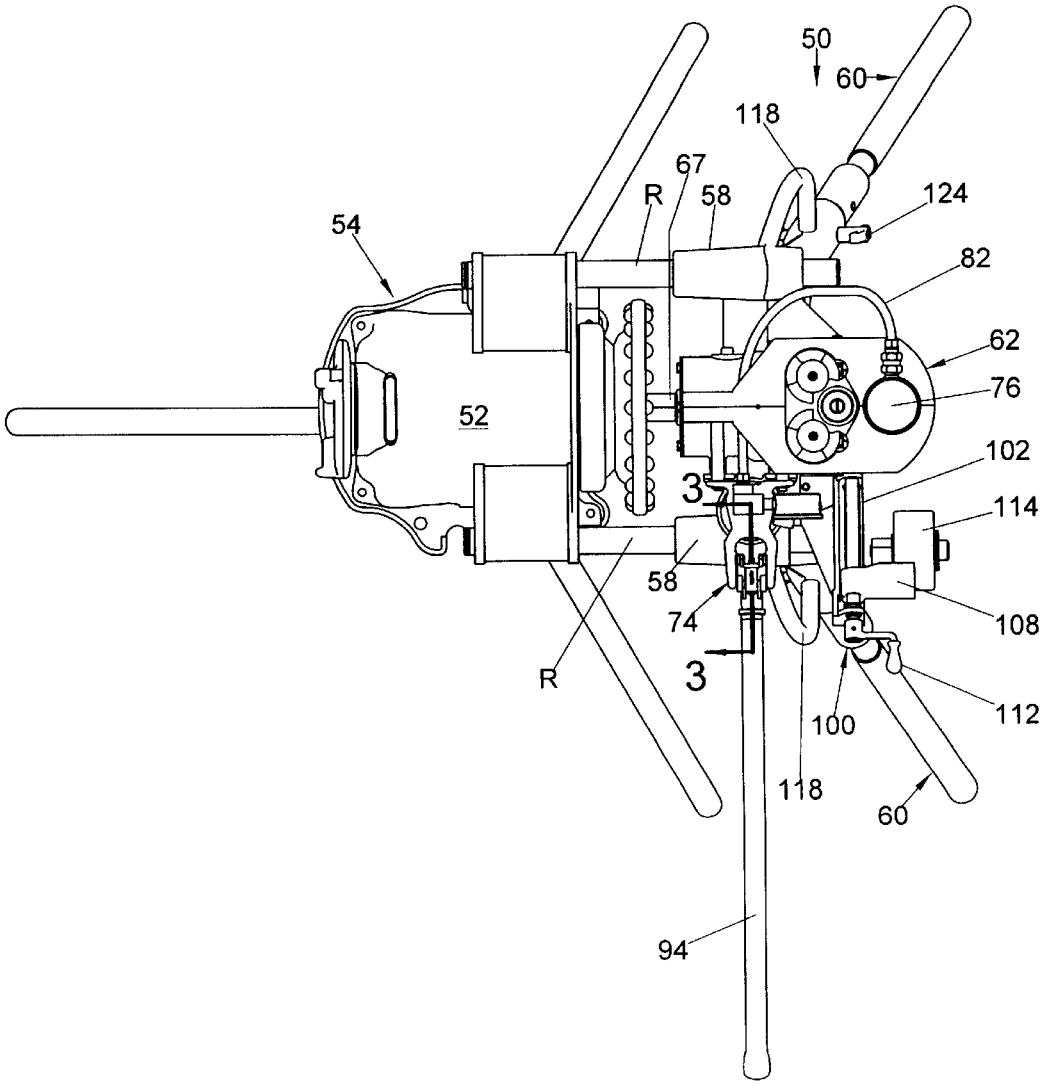
FIG. 2 is a plan view of the apparatus and drive unit shown in FIG. 1.

Referring now in greater detail to the drawings, wherein the showings are for the purpose of illustrating a preferred embodiment of the invention only, and not for the purpose of limiting the invention, FIGS. 1–6 of the drawing illustrate roll grooving apparatus 50 in accordance with the present invention and by which problems regarding the portability and handling of roll grooving apparatus heretofore available are minimized and/or overcome. While roll grooving apparatus 50 could be mounted on a support stand together with a power drive unit, it is preferred for reasons set forth more fully hereinafter to mount the roll grooving apparatus on the support rods R of a drive unit 52 independently mounted on a stand 54. For this purpose, the roll grooving apparatus is provided with a supporting base 56 having sleeves 58 slidably receiving support rods R of the drive unit and having a pair of legs 60 for engaging underlying surface S beneath the roll grooving apparatus. The latter arrangement together with features of the roll grooving apparatus to be described in detail hereinafter enable the latter to be used for roll grooving a larger range of pipe sizes with just one machine than heretofore possible.

Roll grooving apparatus 50 includes a first support member or housing 62 which is bolted or otherwise secured to base 56 and which supports a driven first or back-up grooving roll 64 for rotation about a corresponding grooving roll axis 66. Further, as is well known, support member 62 has a drive shaft including an input end 67 coupled with a chuck on drive unit 52, whereby grooving roll 64 is driven about axis 66 in response to operation of the drive unit. Roll grooving apparatus 50 further includes a second support member 68 on which a second or idler grooving roll 70 is mounted for rotation about a corresponding grooving roll axis 72, and support member 68 is mounted on support member 62 for sliding displacement relative thereto so as to move grooving roll 70 toward and away from grooving roll 64. Displacement of support member 68 and thus grooving roll 70 toward grooving roll 64 is achieved through a manually operable hydraulic pump assembly 74 which delivers hydraulic fluid under pressure to a fluid actuator 76 on support member 62 and which actuator has a piston rod, not shown, attached to support member 68 for displacing the latter and thus roll 70 toward roll 64. A spring, not shown, biases support member 68 relative to support member 62 in the direction to move grooving roll 70 away from grooving roll 64.

Figure 3:
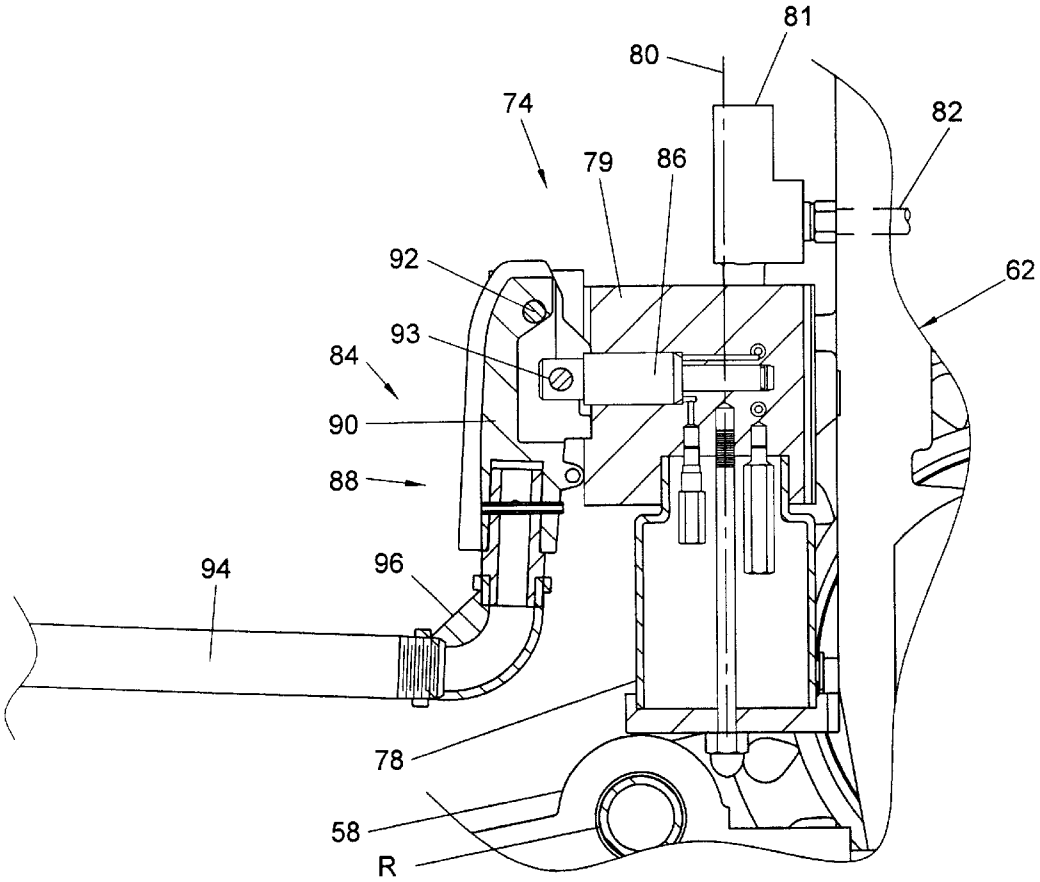
FIG. 3 is a sectional elevation view of the pump assembly, taken along line 3—3 in FIG. 2.
Figure 4:
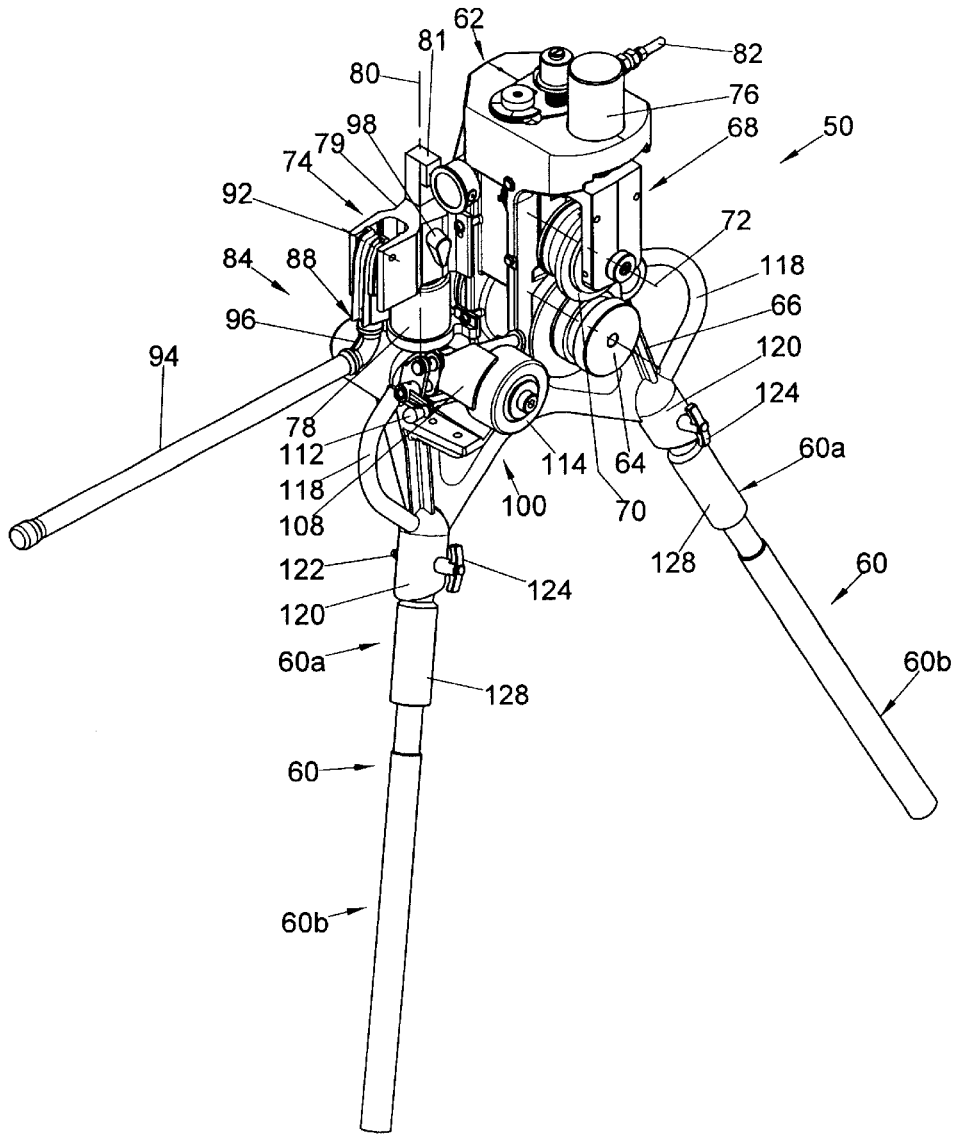
FIG. 4 is a perspective view of the roll grooving apparatus.
Figure 5:
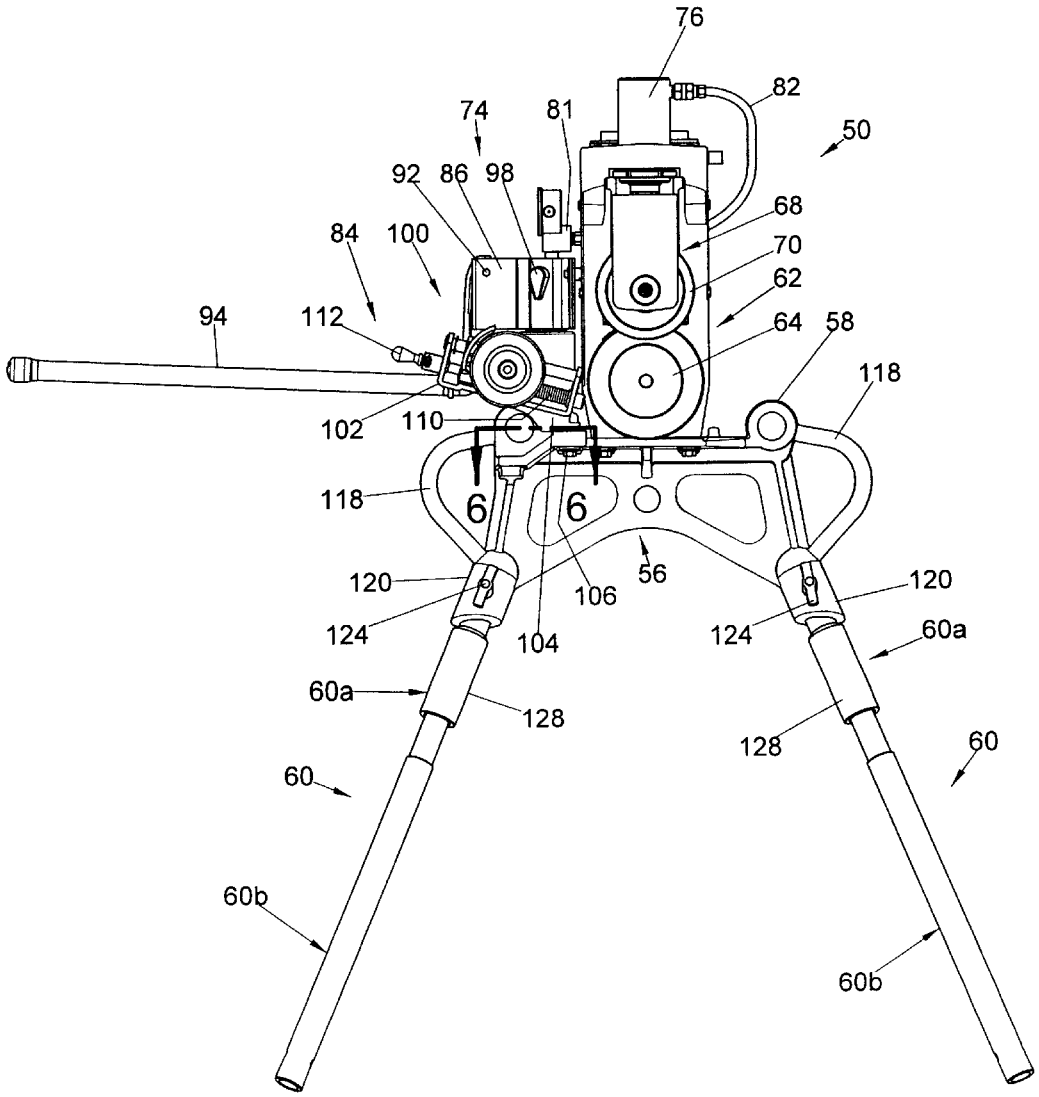
FIG. 5 is a front elevation view of the roll grooving apparatus.

In accordance with one aspect of the invention, and as best seen in FIGS. 3 and 4, hydraulic pump assembly 74 comprises a hydraulic fluid reservoir 78 and housing 79 having a pump axis 80 with respect to the major dimension of the pump as defined by the reservoir and housing. Axis 80 lies in a vertical plane parallel to a plane through grooving roll axes 66 and 72 and in which plane axis 80 is preferably vertical. The reservoir and housing assembly is mounted on support member 62, such as by bolts, not designated numerically. Hydraulic fluid under pressure is adapted to be delivered between pump reservoir 78 and actuator 76 through a pressure gauge and hose coupling 81 on housing 79 and a line or hose 82 between coupling 81 and actuator 76. The delivery of hydraulic fluid under pressure to actuator 76 is achieved in a well-known manner by manually pivoting a pump operating lever mechanism 84 to displace a ram 86 in opposite directions relative to a piston chamber in housing 79, not designated numerically. More particularly in this respect, the lever operating mechanism includes an L-shaped lever member 88 having an inner leg 90 pivotally interconnected with housing 79 by a pivot pin 92 and pivotally interconnected with the outer end of ram 86 by a pivot pin 93. Pivotal displacement of the lever about pin 92 operates in a well-known manner to displace ram 86 through suction and discharge strokes for hydraulic fluid in reservoir 78 to be delivered to actuator 76. Lever 88 further includes an operating handle 94 which is interconnected with leg 90 by an internally threaded ell 96 therebetween. The threaded connection between leg 90, handle 94 and ell 96 advantageously provides for the handle to be removed from ell 96 during transportation of the apparatus and/or to be pivoted with ell 96 horizontally about the axis of leg 90 to a position generally parallel to the lever pivot axis. Such removal or pivoting of the handle provides for locating the handle in a non-use position. In FIG. 5, handle 94 is shown in the use position thereof in which it extends laterally outwardly from one side of the roll grooving apparatus. Accordingly, it will be appreciated that either removal of the handle or pivoting thereof to a position parallel to pivot axis 92 narrows the overall width of the apparatus and thus accommodates portability thereof. Moreover, removability of the handle advantageously enables the selective use of handles of different lengths.

In operation of the pump mechanism, the latter includes a release lever 98 having a closed position in which displacement of lever 88 upwardly and downwardly about the lever axis provides for the delivery of hydraulic fluid under pressure through line 82 to actuator 76 to displace support member 68 and thus grooving roll 70 downwardly toward grooving roll 64. As is well known, such downward displacement of grooving roll 70 with a pipe interposed between the grooving rolls results in producing a groove in the pipe in response to operation of the drive unit to rotate grooving roll 64 and thus the pipe being roll grooved. When a roll grooving operation is completed, the drive unit is turned off and release lever 98 is displaced to its open position which provides for fluid under pressure in actuator 76 to be delivered back to reservoir 78 through line 82, such displacement of the fluid resulting from displacement of support member 68 and thus grooving roll 70 away from grooving roll 64 by the biasing spring between support members and 62.

Figure 6:
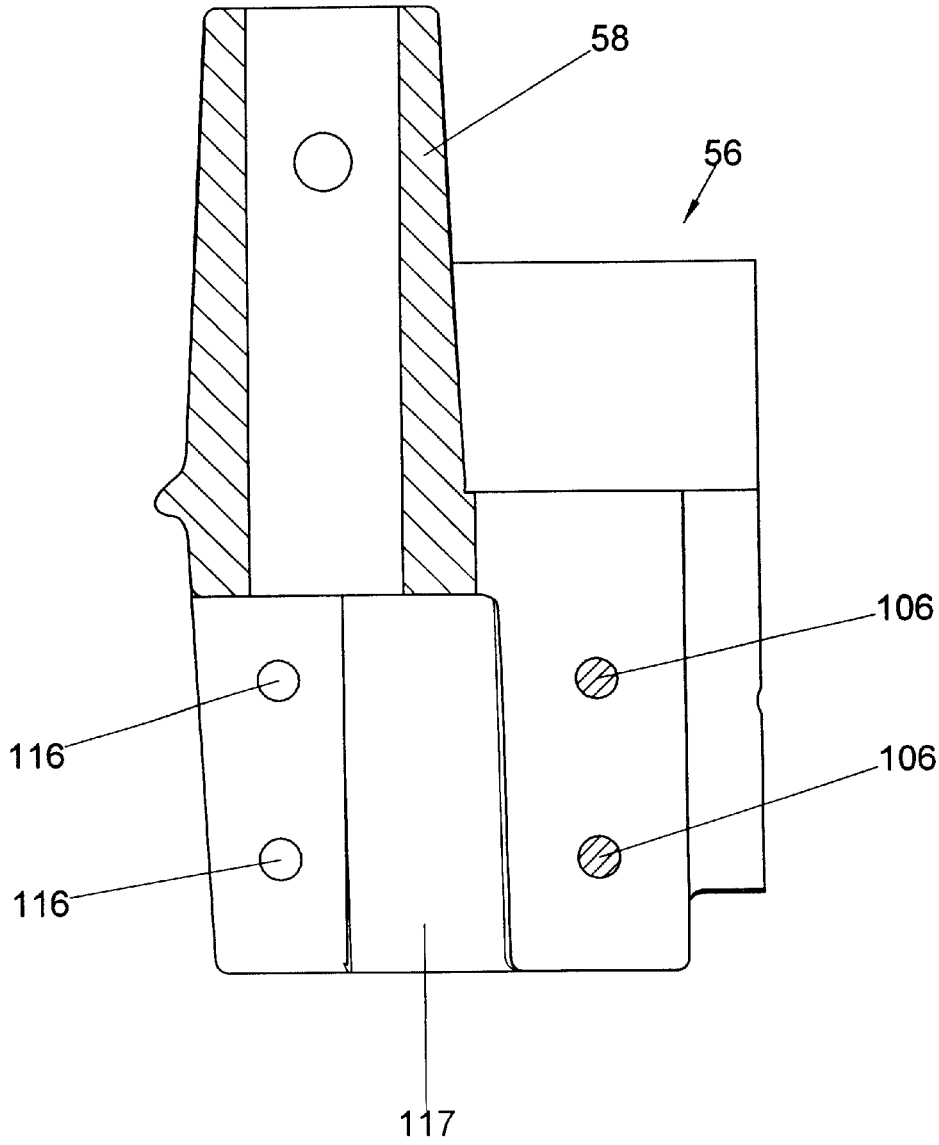
FIG. 6 is a plan view taken along line 6—6 in FIG. 5 and showing the stabilizer mounting locations.

In accordance with another aspect of the invention, a stabilizer 100 is mounted on the same side of the apparatus as pump assembly 74. Stabilizer 100 extends laterally outwardly of the one side and includes a support member 102 having an inner end 104 attached to base 56 of the roll grooving apparatus, such as by bolts 106. The stabilizer further includes a carriage 108 supported on member 102 for displacement laterally inwardly and outwardly of the apparatus by a screw component 110 which is adapted to be rotated in opposite directions by a crank 112 interconnected with the outer end thereof. The inner end of carriage 108 is provided with a stabilizer wheel 114 which is rotatably mounted thereon and which, as is well known, is adapted to engage the outer surface of a pipe being roll grooved so as to stabilize the pipe. In accordance with another aspect of the invention, the same stabilizer 100 is adapted to be mounted on base 56 of the apparatus at either one of two laterally spaced apart locations thereon. In this respect, for example, as shown in FIG. 6 of the drawing, base 56 is provided with a pair of mounting holes 116 laterally outwardly of the mounting holes receiving bolts 106. This arrangement advantageously allows the same, small size stabilizer which is used for roll grooving pipe from two inches to sixteen inches, for example, to be used in roll grooving pipe ranging from sixteen inches to twenty-four inches in diameter on the same machine simply by relocating the stabilizer at the laterally outer mounting location to accommodate the larger sized pipes. Moreover, by locating the stabilizer on the same side of the as the pump, the overall width of the apparatus is advantageously reduced to promote ease with respect to the portability thereof. While stabilizer 100 is mounted on supporting base 56 in the preferred embodiment, it will be appreciated that the stabilizer could be mounted on support member 62 of the apparatus such as through the use of an appropriate mounting bracket. In the disclosed embodiment, as will be appreciated from FIGS. 5 and 6 of the drawing, the laterally outer and inner portions of base 56 respectively having openings 116 and the openings for bolts 106, are horizontal, vertically offset and interconnected by an inclined ramp portion 117 therebetween. As an alternative to this configuration, the portion of base 56 supporting the stabilizer could be a planar surface between the inner and outer ends thereof with a pair of laterally extending slots having inner and outer ends of the locations of the openings for bolts 106 and openings 116. Then, it would only be necessary to loosen bolts 106 and slide the stabilizer between the inner and out positions thereof. In accordance with yet another aspect of the invention, supporting base 56 of the roll grooving apparatus is provided with handles 118 on the laterally opposite sides thereof which facilitate the mounting and removal of the apparatus from the support rails R of the power drive unit and the transporting of the apparatus from one location to another. Further in this respect, supporting base 56 is provided with tubular sockets 120 for receiving the upper end of the corresponding one of the legs 60, and the legs are removably retained in sockets 120 by pins 122 which extend through aligned openings therefor in sockets 120 and the upper ends of the legs. Pins 122 are provided with knobs or handles 124 on one end thereof to facilitate introducing the pins through the openings in the sockets and legs, and the opposite ends of the pins project outwardly from the corresponding socket and receive a clevis pin 126 to preclude unintentional removal of the pins 122. Each of the legs 60 includes an upper leg portion 60*a* and a lower leg portion 60*b*. The lower end of each upper leg portion 60*a* terminates in an internally threaded sleeve 128, and the upper end of each lower leg portion 60*b* is externally threaded for threaded interengagement with the corresponding one of the sleeves 128. The threaded interengagement advantageously provides for each of the legs 60 to be adjusted in length to enable leveling of the apparatus in conjunction with the mounting thereof on the drive unit prior to use. The removability of the legs provides two advantages in connection with transporting the apparatus, namely minimizing the lateral width of the apparatus and eliminating the potential interference thereof with persons carrying the apparatus.

While considerable emphasis has been placed herein on the structures and structural interrelationships between the component parts of the preferred embodiment of the invention, it will be appreciated that other embodiments can be made and that many changes can be made in the preferred embodiment without departing from the principals of the invention. In this respect in particular, cylinder axis 80 could be oriented other than vertically in the vertical plane in which it lies, and the pump handle could be collapsible as opposed to or in addition to being removable from the pump during non-use of the apparatus. Further a spring clip or the like could be provided on the supporting base 56 and/or support member 62 of the apparatus to provide for storage of the pump handle when removed. Still further, pivotal displacement of the handle relative to leg 90 of the lever as well as removability of the handle from the latter can be achieved through a connection other than the internally threaded ell illustrated and described herein. These and other modifications of the preferred embodiment as well as other embodiments of the invention will be suggested or obvious from the disclosure herein, whereby it is to be distinctly understood that the foregoing descriptive matter is to be interpreted merely as illustrative of the invention and not as a limitation.

Having thus described the invention, it is so claimed:

1. In roll grooving apparatus comprising a pair of vertically oriented grooving rolls, means supporting the grooving rolls for rotation about a corresponding roll axis, fluid actuated means for displacing one of said grooving rolls toward the other, and a manually operated pump for supplying fluid under pressure to said fluid actuated means, the improvement comprising: said pump having a major dimension providing a pump axis and being supported on the apparatus with said pump axis extending in a plane parallel to a plane through the grooving roll axes.

2. The improvement according to claim 1, and a pump operating handle removably supported thereon.

3. The improvement according to claim 1, wherein said apparatus includes a housing supporting said grooving rolls, and said pump is mounted on said housing.

4. The improvement according to claim 1, and a pump lever pivotal in opposite directions about a lever axis for operating said pump.

5. The improvement according to claim 4, wherein said lever axis is horizontal and said opposite directions is between upper and lower positions.

6. The improvement according to claim 1, wherein said apparatus has laterally opposite sides with respect to the grooving rolls, said pump being mounted on one of said opposite sides.

7. The improvement according to claim 6, wherein said apparatus further includes a stabilizer for a pipe being roll grooved, said stabilizer being mounted on said one side of said apparatus.

8. The improvement according to claim 7, and a pump operating lever pivotal in opposite directions about a lever axis for operating said pump.

9. The improvement according to claim 8, wherein said lever axis is horizontal and said opposite directions is between upper and lower positions.

10. The improvement according to claim 9, wherein said lever includes a removable handle.

11. The improvement according to claim 7, wherein said means supporting said grooving rolls includes a support member for one of said grooving rolls and a plate member underlying said support member, said pump being mounted on said support member, and said stabilizer being mounted on said plate member.

12. The improvement according to claim 1, and a pump operating lever having a handle pivotal relative to the apparatus between a use position transverse to the roll axes and a non-use position generally parallel to the roll axes.

13. The improvement according to claim 12, wherein said handle is removable from said lever.

14. The improvement according to claim 12, wherein said handle in said use position is displaceable in opposite directions about a lever axis for operating said pump.

15. The improvement according to claim 14, wherein said lever axis is horizontal and said opposite directions is between upper and lower positions.

16. The improvement according to claim 15, wherein said handle is removable from said lever.

17. The improvement according to claim 12, wherein said apparatus has laterally opposite sides with respect to the grooving rolls, said pump being mounted on one of said opposite sides.

18. The improvement according to claim 17, wherein said apparatus further includes a stabilizer for a pipe being roll grooved, said stabilizer being mounted on said one side of said apparatus.

19. The improvement according to claim 18, wherein said operating lever is pivotal in opposite directions about a lever axis for operating said pump.

20. The improvement according to claim 18, wherein said handle in said use position is displaceable in opposite directions about a lever axis for operating said pump.

21. The improvement according to claim 20, wherein said lever axis is horizontal and said opposite directions is between upper and lower positions.

22. The improvement according to claim 21, wherein said handle is removable from said lever.

23. The improvement according to claim 1, wherein said apparatus has laterally opposite sides with respect to the grooving rolls, said pump being on one of said opposite sides, a stabilizer on said one side, said stabilizer having a mounting end and an operating end spaced laterally outwardly of said mounting end, and said mounting end being selectively mountable on said one side of said apparatus at either one of two laterally spaced mounting locations.

24. The improvement according to claim 23, and a pump operating lever pivotal in opposite directions about a lever axis for operating said pump.

25. The improvement according to claim 24, wherein said lever axis is horizontal and said opposite directions is between upper and lower positions.

26. The improvement according to claim 25, wherein said lever includes a handle removable therefrom.

27. The improvement according to claim 23, wherein said means supporting said grooving rolls includes a support member for one of said grooving rolls and a plate member underlying said support member, said pump being mounted on said support member, and said stabilizer being mounted on said plate member.

28. In roll grooving apparatus comprising vertically oriented idler and backup grooving rolls, means supporting the idler roll and the backup roll for rotation about a corresponding roll axis, fluid actuated means for displacing said idler roll toward said backup roll, and a manually operated pump for supplying fluid under pressure to said fluid actuated means, the improvement comprising: said pump having an axis and axially opposite ends, a lever mounted on one of said ends for pivotal displacement in opposite directions about a lever axis for operating said pump, and said pump being supported on said apparatus with the cylinder axis vertical.

29. The improvement according to claim 28, wherein said lever axis is horizontal and said lever is pivotal about a second axis transverse to said lever axis between a use position transverse to the roll axes and a non-use position generally parallel to the roll axes.

30. The improvement according to claim 28, wherein said lever includes a handle removable therefrom.

31. The improvement according to claim 28, wherein said apparatus has laterally opposite sides with respect to the grooving rolls, said pump being on one of said opposite sides, a stabilizer on said one side, said stabilizer having a mounting end and an operating end spaced laterally outwardly of said mounting end, and said mounting end being selectively mountable on said one side of said apparatus at either one of two laterally spaced mounting locations.

32. The improvement according to claim 31, wherein said means supporting said grooving rolls includes a support member for one of said grooving rolls and a plate member underlying said support member, said pump being mounted on said support member, and said stabilizer being mounted on said plate member.

33. The improvement according to claim 28, wherein said one of said opposite ends of said pump is the upper end thereof.

34. The improvement according to claim 28, wherein said apparatus has laterally opposite sides with respect to the grooving rolls, said pump being mounted on one of said opposite sides, and a stabilizer mounted on said one side.

35. The improvement according to claim 34, wherein said lever includes a handle removable therefrom.

36. The improvement according to claim 35, wherein said stabilizer has a mounting end and an operating end spaced laterally outwardly of said mounting end, and said mounting end being selectively mountable on said one side of said apparatus at either one of two laterally spaced mounting locations.

37. The improvement according to claim 36, wherein said one of said opposite ends of said pump is the upper end thereof.

38. The improvement according to claim 37, wherein said lever axis is horizontal and said lever is pivotal about a second axis transverse to said lever axis between a use position transverse to the roll axes and a non-use position generally parallel to the roll axes.

39. In roll grooving apparatus comprising a pair of vertically oriented grooving rolls, means supporting the grooving rolls for rotation about a corresponding roll axis, fluid actuated means for displacing one of said grooving rolls toward the other, a manually operated pump for supplying fluid under pressure to said fluid actuated means, and a stabilizer for a pipe being roll grooved, said stabilizer being on just one side of the apparatus with respect to the grooving roll axes, the improvement comprising: said pump and said stabilizer being on the same side of the apparatus with respect to the grooving roll axes, and a pump operating lever including a removable handle.

40. The improvement according to claim 39, wherein said pump has a pump axis in a plane parallel to a plane through the grooving roll axes.

41. The improvement according to claim 39, wherein said means supporting said grooving rolls includes a support member for one of said grooving rolls and a plate member underlying said support member, said pump being mounted on said support member, and said stabilizer being mounted on said plate member.

42. The improvement according to claim 41, wherein said lever is pivotal about a horizontal lever axis between upper and lower positions.

43. The improvement according to claim 42, wherein said pump has a pump axis in a plane parallel to a plane through the grooving roll axes.

44. The improvement according to claim 39, wherein said stabilizer has a mounting end and an operating end spaced laterally outwardly of said mounting end, and said mounting end being selectively mountable on said same side at either one of two laterally spaced mounting locations.

45. The improvement according to claim 44, wherein said lever is pivotal in opposite directions about a lever axis for operating said pump.

46. The improvement according to claim 45, wherein said pump has a pump axis in a plane parallel to a plane through the grooving roll axes.

47. The improvement according to claim 44, wherein said means supporting said grooving rolls includes a support member for one of said grooving rolls and a plate member underlying said support member, said pump being mounted on said support member, and said stabilizer being mounted on said plate member.

* * * * *